US005375971A

United States Patent [19]

Yu

[11] Patent Number: 5,375,971

[45] Date of Patent: Dec. 27, 1994

[54] AUTOMOTIVE FUEL PUMP FLOW CHANNEL DESIGN

[75] Inventor: Dequan Yu, Ann Arbor, Mich.

[73] Assignee: Ford Motor Company, Dearborn, Mich.

[21] Appl. No.: 131,169

[22] Filed: Oct. 4, 1993

[51] Int. Cl.[5] ..... F04D 29/40

[52] U.S. Cl. ..... 415/55.1

[58] Field of Search ..... 415/55.1, 55.2, 55.3, 415/55.4, 55.5

[56] References Cited

U.S. PATENT DOCUMENTS

| | | | |
|---|---|---|---|
| 1,689,579 | 10/1928 | Burks . | |
| 1,768,242 | 6/1930 | Ferguson | 415/55.1 |
| 4,231,718 | 11/1980 | Ruhl et al. | 415/55.1 |
| 4,483,656 | 11/1984 | Abe et al. | 415/55.2 |
| 5,011,367 | 4/1991 | Yoshida et al. | 415/55.1 |

FOREIGN PATENT DOCUMENTS

| | | | |
|---|---|---|---|
| 070529 | 7/1982 | European Pat. Off. . | |
| 1382230 | 11/1964 | France . | |
| 876285 | 5/1953 | Germany | 415/55.2 |
| 2131952 | 1/1973 | Germany | 415/55.1 |
| 10193 | 1/1983 | Japan | 415/55.1 |
| 195094 | 11/1983 | Japan . | |
| 177489 | 7/1989 | Japan . | |
| 377551 | 1/1973 | U.S.S.R. | 415/55.1 |
| 1268817 | 11/1986 | U.S.S.R. | 415/55.1 |

OTHER PUBLICATIONS

SAE Paper No. 870121—"Development Of A Turbine In-Tank Fuel Pump" Y. Hattori, H. Kobayashi and K. Shinoda (1987).

*Primary Examiner*—John T. Kwon

*Attorney, Agent, or Firm*—David B. Kelley; Roger L. May

[57] ABSTRACT

A fuel pump has a motor which rotates a shaft with an impeller fitted thereon for pumping fuel within a pumping chamber comprised of semi-elliptically shaped flow channels formed in a pump cover and a pump bottom which encase the impeller. Primary vortices developed by the rotary pumping action of the impeller closely approximate the shape of the pumping chamber thus minimizing secondary counterflowing vortices with their attendant decrease in pump efficiency. An alternative design is the special case of an ellipse where the major axis and the minor axis of the ellipse have equal lengths such that the pumping chamber has semi-circular shaped flow channels.

19 Claims, 2 Drawing Sheets

AUTOMOTIVE FUEL PUMP FLOW CHANNEL DESIGN

FIELD OF THE INVENTION

This invention relates to automotive fuel pumps, and, more particularly, to a regenerative turbine fuel pump having a pumping cheer which optimally forms primary flow vortices and reduces secondary vortices.

1. Background of the Invention

Regenerative turbine fuel pumps for automobiles typically operate by having a rotary element, for example an impeller, mounted on a motor shaft within a pump housing. A pumping chamber around the outer circumference of the rotary element is formed of two halves: a cover channel in the pump cover and a bottom channel in the pump bottom. Fuel is drawn into a fuel inlet, located at the beginning of the cover channel and axially across from the beginning of the bottom channel, and flows to either the cover channel or the bottom channel. Primary vortices are formed within each channel of the chamber by the pumping action of the rotary element and are propelled to the ends of each channel before being expelled through the fuel outlet, which is located at the end of the bottom channel. Pumping losses occur when secondary vortices develop in those areas of the flow channels which do not conform to the shape of primary vortices. The geometric shape of the flow channels comprising the pumping chamber thus becomes important in minimizing formation of secondary vortices.

2. Description of the Prior Art

As shown in FIG. 8, conventional prior art flow channels 80 have a flat-sided section 81 with rounded corners 88. U.S. Pat. No. 5,011,367 (Yoshida et al.) and Japanese Patent 177489 (Mine) disclose similar flow channels. In such flow channels, secondary vortices 84 develop near corners 88 since primary vortices 82 do not conform to the shape of flow channel 80. The secondary vortices 84 flow counter to primary vortices 82 thus decreasing pump efficiency by slowing fuel travel through pumping chamber 66. An alternative design, shown in FIG. 9, employs flattened corners 86 which yield trapezoidal shaped flow channels 90 of pumping chamber 66. Japanese Patent 195094 (Matsuda) discloses such a flow channel. This modification apparently reduces the area where counterflow is generated, as discussed in SAE Paper 870121, Development of a Turbine In-Tank Fuel Pump, page 5. This design does not, however, prevent secondary vortices 84 from developing near the trapezoidal corners 92 and flowing counter to primary vortices 82.

SUMMARY OF THE INVENTION

An object of the present invention is to overcome the disadvantages of prior fuel flow channel designs by providing semi-elliptically shaped channels in a pump cover and a pump bottom which interact with a pump impeller to form elliptically shaped primary vortices in the flow channel when fuel is pumped such that secondary vortices are minimized or eliminated.

Another object of the present invention is to provide an automotive fuel pump with a pumping chamber which allows smoother fuel flow through the pump so as to improve pump efficiency.

These objects are accomplished by providing a fuel pump for supplying fuel from a fuel tank to an automotive engine, with the pump comprising a pump housing, a motor mounted within the housing having a shaft extending therefrom and able to rotate upon application of an electrical current to the motor and a rotary pumping element, preferably an impeller or a regenerative turbine, attached to the shaft for rotatably pumping fuel. A pump bottom, which is mounted to the housing, has an outlet therethrough in fluid communication with a motor chamber surrounding the motor, an opening for allowing the shaft to pass through to connect to the impeller, and a semi-elliptically shaped channel formed along an outer circumference of the impeller mating surface of the pump bottom. A pump cover, also having a semi-elliptically shaped channel formed along an outer circumference of the impeller mating surface, is mounted on an end of the housing and is attached to the pump bottom with the impeller positioned between the two. A pumping chamber is thus formed between the pump cover and the pump bottom. When the impeller rotates, elliptically shaped primary vortices are created in the pumping chamber such that secondary vortices are minimized or eliminated, thus resulting in higher pump efficiency. The pump cover also has a fuel inlet therethrough in fluid communication with the fuel tank and with the pumping chamber.

DETAILED DESCRIPTION OF THE PREFERRED EMBODIMENTS

Figure 1:
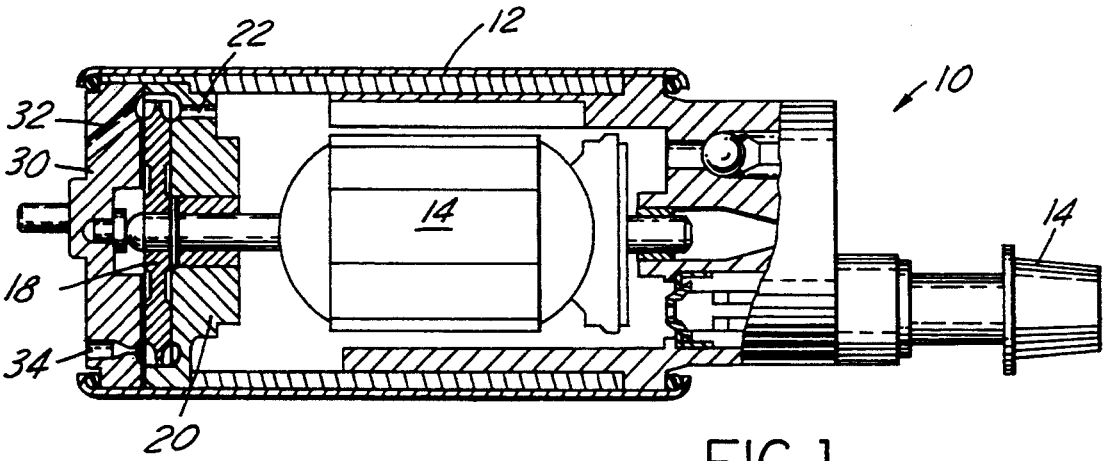
FIG. 1 is a cross-sectional view of a fuel pump according to the present invention.

Referring now to FIG. 1, a fuel pump 10 has a housing 12 for containing a motor 14, preferably an electric motor, which is mounted within motor space 36. Motor 14 has a shaft 16 extending therefrom toward the direction of an outlet 44 to an inlet 32, as shown with greater detail in FIG. 2. A rotary pumping element, preferably an impeller 18, or, alternatively, a regenerative turbine, is fitted on shaft 16 and encased within a pump bottom 20 and a pump cover 30. Impeller 18 has a central axis which is coincident with the axis of shaft 16. Shaft 16 passes through impeller 18 and into cover recess 38 of pump cover 30. Shaft 16 is journalled within bearing 24. Pump bottom 20 has a fuel outlet 22 leading from a pumping chamber 26 formed along the periphery of impeller 18. Pressurized fuel is discharged through fuel outlet 22 to motor space 36 and cools motor 14 while passing over it to pump outlet 44 at an end of pump 10 axially opposite fuel inlet 32 (FIG. 1).

Figure 6:
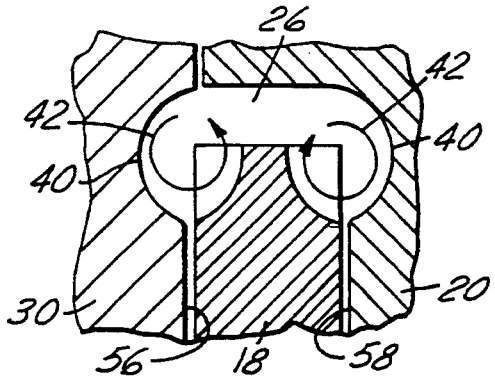
FIG. 6 is a cross-sectional view of semicircular flow channels according to an alternate embodiment of the present invention which are a special case of the semi-elliptical flow channels of FIG. 3.

Fuel is drawn from a fuel tank (not shown), in which pump 10 may be mounted, through fuel inlet 32 in pump cover 30, and into pumping chamber 26 by the rotary pumping action of impeller 18. As impeller 18 rotates, primary vortices 42 (FIG. 3) are formed in flow channels 40 and are propelled circumferentially around annular pumping chamber 26 to fuel outlet 22. Annular flow channels 40, which cooperate to form pumping chamber 26, are fashioned circumferentially along a radially outward portion of impeller mating surfaces 56 and 58 of pump cover 30 and pump bottom 20, respectively (FIG. 6). FIG. 4 shows the position of flow channel 40 on impeller mating surface 56 of pump cover 30. Pump bottom 20 has a similarly arranged flow channel 40.

Figure 3:
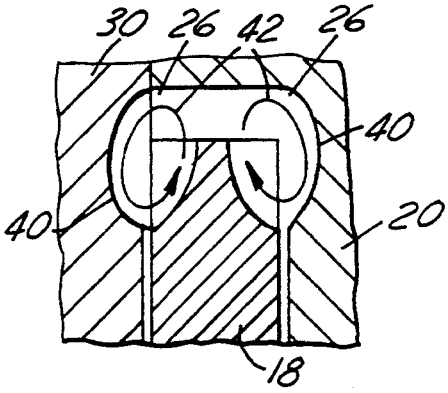
FIG. 3 is a cross-sectional view of the semi-elliptically shaped flow channels according to the present invention which form a pumping chamber for the fuel pump of FIG. 1.
Figure 8:
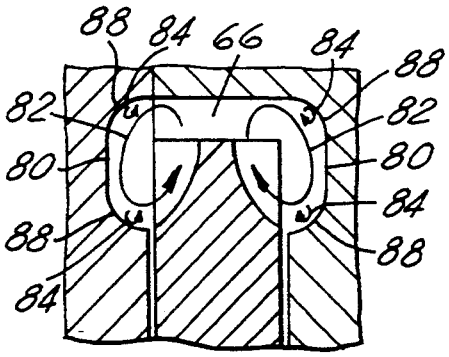
(PRIOR ART) FIG. 8
FIG. 8 is a cross-sectional view of a prior art fuel pump flow channel showing flat sides and secondary vortices formed in the corners of the flow channel.
Figure 9:
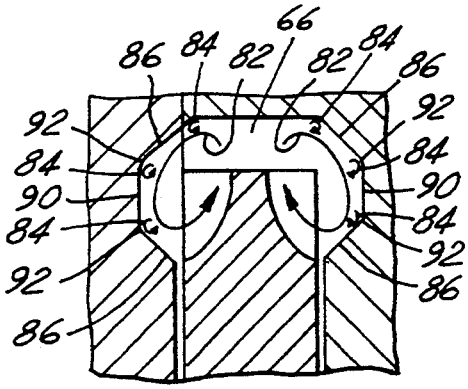
(PRIOR ART) FIG. 9
FIG. 9 is a cross-sectional view of a trapezoidal shaped prior art fuel pump flow channel showing secondary vortices formed in the corners of the flow channel.
Figure 5:
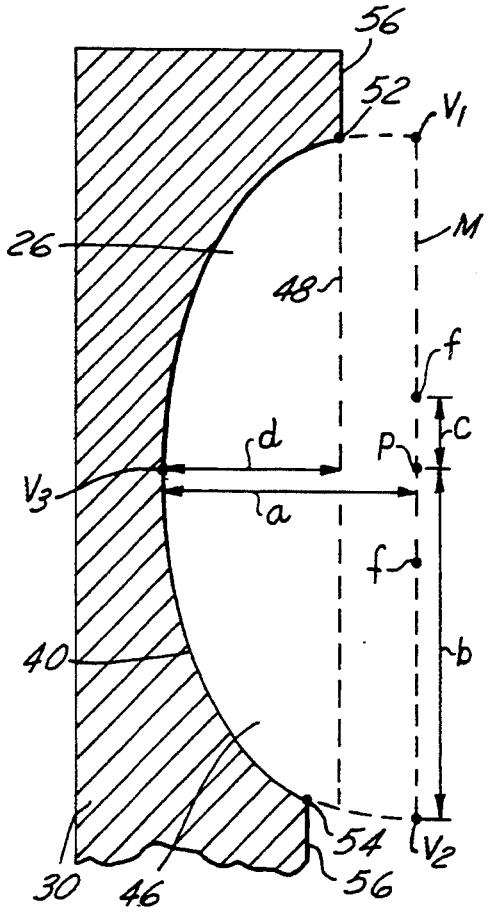
FIG. 5 shows diagrammatically the relevant parameters of the semi-elliptically shaped flow channels of FIG. 3.
Figure 4:
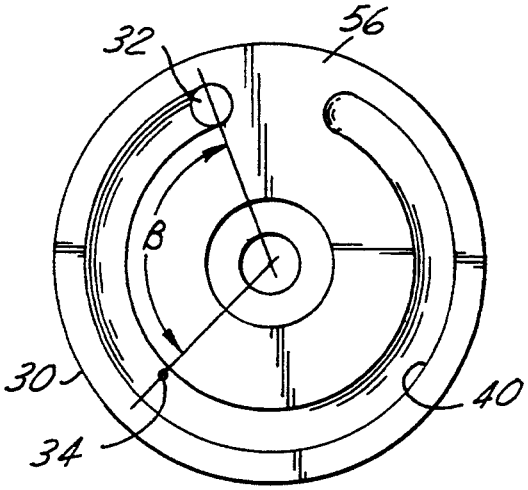
FIG. 4 is a view taken along line 4—4 of FIG. 2 showing a pump cover with an impeller mating surface having a flow channel running circumferentially along a radially outward portion of the pump cover.

As shown in FIG. 3, the preferred shape for flow channels 40 is semi-elliptical because primary vortices 42 within pumping chamber 26 are elliptically shaped. Secondary vortices are thus eliminated or significantly reduced as is the attendant counterflow so that pump efficiency is increased. FIG. 5 shows elliptical parameters which define flow channel 40 in pump cover 30. Pump bottom 20 has a similarly shaped flow channel 40. The shape of flow channel 40 is given by the following ellipsoidal equation:

$$\frac{x^2}{a^2} + \frac{y^2}{b^2} = 1$$

where a=half the distance of the minor axis, b=half the distance of the major axis, M and x and y are the axes of a Cartesian coordinate system centered on the point, p.

As is known in the field of geometry, the major axis, M, of an ellipse extends along an axis from vertex $v_1$, through center, p, to vertex $v_2$. Length b extends from center p to either of the vertices, $v_1$ or $v_2$, and is shown extending to $v_2$ in FIG. 5. The foci of the ellipse, f, are a distance c from center p along major axis M. The length a, which is half the distance of the minor axis (not shown), extends between center p and co-vertex $v_3$. A preferred range of values for length a is between 0.8 and 2.5 millimeters, with a preferred length of 1.0 millimeter. The preferred range of values for length b is between 0.9 and 2.7 millimeters, with a preferred length of 1.18 millimeters. Length c is calculated as a function of lengths a and b as follows:

$$c^2=b^2-a^2.$$

Preferably, c is 0.625 millimeters in length and has a range which varies with lengths a and b according to the above equation.

As seen in FIG. 5, the cross-section 46 of flow channel 40 may be only a portion of a full semi-ellipse 50. Semi-ellipse 50 is defined by major axis M and the ellipsoidal line having vertices $v_1$ and $v_2$, and co-vertex $v_3$. On the other hand, cross-section 46 is defined by line 48, which is at depth d in pump cover 30 coaxial with length a, and the curvilinear portion of semi-ellipse 50 between points 52 and 54. Preferably, depth d is 0.95 millimeters, but has a range of 0.5 to 2.5 millimeters, and, in any case, is less than or equal to length a. The preferred depth d is based on a desired fuel flowrate of 120 lph (liters per hour).

In an alternate embodiment shown in FIG. 6, the shape of flow channel 40 is the special case of an ellipse where length a equals length b. As is well known in geometry, that shape is a semi-circle defined by the following equation:

$$\frac{x^2}{a^2} + \frac{y^2}{b^2} = 1$$

where a=b=the radius of the circle.

Figure 7:
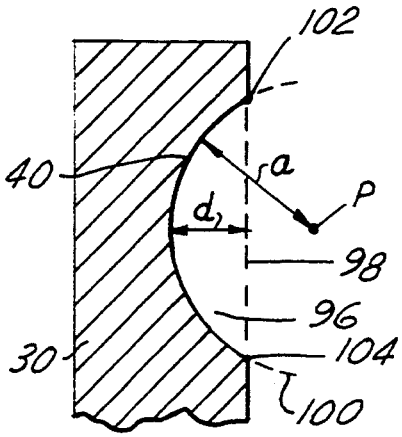
FIG. 7 shows diagrammatically the relevant parameters of the semi-circular shaped flow channels of FIG. 5.

As with the semi-elliptical flow channel described above, the semi-circular cross-section 96 of flow channel 40 may be only a portion of a full semi-circle 100. FIG. 7. Semi-circle 100 is defined by radius a. On the other hand, cross-section 96 is defined by line 98, which is at depth d in pump cover 30 along a line perpendicular to line 98, and the curvilinear portion of semi-circle 100 between points 102 and 104. Radius a preferably has a range between 1.5 and 2.5 millimeters. Depth d has a preferred range of between 0.5 and 1.5 millimeters, and, in any case, is less than or equal to radius a. Various fuel flowrates can be achieved with the foregoing range of parameters, but preferably depth d is 0.9 millimeters for a flowrate of 100–120 lph, and 1.2 millimeters which will produce of flowrate of 200 lph.

Figure 2:
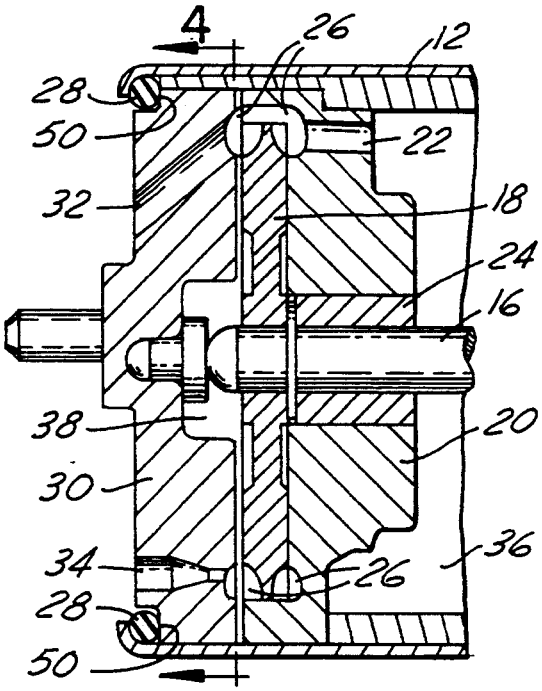
FIG. 2 is a partial cross-sectional view of the fuel pump of FIG. 1 showing the pumping section in greater detail.

As seen in FIG. 2, a purge orifice 34 extends axially through pump cover 30 to bleed fuel vapor from pumping chamber 26 so that vaporless liquid fuel reaches the engine (not shown). Fuel vapor passes from pumping chamber 26, through purge orifice 34, and into the fuel tank (not shown). Preferably, purge orifice 34 is located at a radially inward portion of cover channel 40 approximately 100°–120° from fuel inlet 32 as shown by angle δ in FIG. 4.

Flow channels 40 can be die cast along with pump bottom 20 and pump cover 30, preferably in aluminum, or can be machined into pump bottom 20 and pump cover 30. Alternatively, flow channels 40 can be integrally molded together with pump bottom 20 and pump cover 30 out of a plastic material, such as acetyl or other plastic or non-plastic materials known to those skilled in the art and suggested by this disclosure.

Although the preferred embodiments of the present invention have been disclosed, various changes and modifications may be made without departing from the scope of the invention as set forth in the appended claims.

I claim:

1. A fuel pump for supplying fuel from a fuel tank to an automotive engine, comprising:

a pump housing;

a motor mounted within said housing having a shaft extending therefrom;

an impeller attached to said shaft for rotatably pumping fuel;

a pump bottom mounted to said housing having an outlet therethrough in fluid communication with a motor chamber surrounding said motor, said pump bottom having an opening for allowing said shaft to pass through to connect to said impeller, and with a semi-elliptically shaped flow channel formed along an outer circumference of an impeller mating surface of said pump bottom;

a pump cover mounted on an end of said housing and attached to said pump bottom with said impeller therebetween such that a pumping chamber is formed between a semi-elliptically shaped flow channel formed along an outer circumference of an impeller mating surface of said pump cover and said semi-elliptically shaped flow channel of said pump bottom, so that elliptically shaped primary vortices develop in said pumping chamber conforming to the shape of said pumping chamber upon rotation of said impeller such that secondary vortices are minimized, Said pump cover flow channel and said pump bottom flow channel having a depth less than half the minor axis of an ellipse of same cross-sectional shape, and with said pump cover having a fuel inlet therethrough in fluid communication with said fuel tank and with said pumping chamber.

2. A fuel pump according to claim 1 wherein said semi-elliptical flow channels in said pump cover and said pump bottom are shaped according to an ellipse having a center to vertex distance in the range of 0.9 to 2.7 millimeters, and having a center to co-vertex distance of 0.8 to 2.5 millimeters.

3. A fuel pump according to claim 2 wherein the depth of said flow channels along an axis from said center to said co-vertex of said ellipse from a plane co-planar with said impeller mating surface of said pump cover and said pump bottom is between 0.5 and 2.5 millimeters, said depth also being less than or equal to the distance between said center and said co-vertex of said ellipse.

4. A fuel pump according to claim 1 wherein said center to vertex distance is 1.18 millimeters, and wherein said center to co-vertex distance is 1.0 millimeters.

5. A fuel pump according to claim 4 wherein said depth of said flow channels along an axis from said center to said co-vertex of said ellipse from a plane co-planar with said impeller mating surface of said pump cover and said pump bottom is 0.95 millimeters.

6. A fuel pump according to claim 1 wherein said semi-elliptical flow channels in said pump cover and said pump bottom have a center to vertex distance equal to the center to co-vertex distance so that the cross-sectional shape of said flow channels is semi-circular, with the radius of said flow channels being in the range of 1.5 to 2.5 millimeters.

7. A fuel pump according to claim 6 wherein the depth of said flow channels along a line perpendicular to the plane of said impeller mating surfaces of said pump cover and said pump bottom is between 0.5 and 1.5 millimeters, said depth also being less than or equal to said radius of said semi-circular cross-section.

8. A fuel pump according to claim 6 wherein said depth of said flow channels along a line perpendicular to the plane of said impeller mating surfaces of said pump cover and said pump bottom is 0.9 millimeters which yields a fuel pump flowrate of 100–120 liters per hour.

9. A fuel pump according to claim 6 wherein said depth of said flow channels along a line perpendicular to the plane of said impeller mating surfaces of said pump cover and said pump bottom is 1.2 millimeters which yields a fuel pump flowrate of 200 liters per hour.

10. A fuel pump for supplying fuel from a fuel tank to an automotive engine, comprising:

a pump housing;

a motor mounted within said housing having a shaft extending therefrom;

a rotary pumping element attached to said shaft for rotatably pumping fuel;

a pump bottom mounted to said housing having an outlet therethrough in fluid communication with a motor chamber surrounding said motor, said pump bottom having an opening for allowing said shaft to pass through to connect to said rotary pumping element, and with a semi-elliptically shaped flow channel formed along an outer circumference of a rotary pumping element mating surface of said pump bottom;

a pump cover mounted on an end of said housing and attached to said pump bottom with said rotary pumping element therebetween such that a pumping chamber is formed between a semi-elliptically shaped flow channel formed along an outer circumference of an rotary pumping element mating surface of said pump cover and said semi-elliptically shaped flow channel of said pump bottom, so that elliptically shaped primary vortices develop in said pumping chamber conforming to the shape of said pumping chamber upon rotation of said rotary pumping element such that secondary vortices are minimized, said pump cover flow channel and said pump bottom flow channel having a depth less than half the radius of a circle of same cross-sectional shape, and with said pump cover having a fuel inlet therethrough in fluid communication with said fuel tank and with said pumping chamber.

11. A fuel pump according to claim 10 wherein said rotary pumping element comprises a regenerative turbine.

12. A fuel pump according to claim 11 wherein said center to vertex distance is 1.18 millimeters, and wherein said center to co-vertex distance is 1.0 millimeters.

13. A fuel pump according to claim 12 wherein said depth of said flow channels along an axis from said center to said co-vertex of said ellipse from a plane coplanar with said impeller mating surface of said pump cover and said pump bottom is 0.95 millimeters.

14. A fuel pump according to claim 11 wherein said semi-elliptical flow channels in said pump cover and said pump bottom have a center to vertex distance equal to the center to co-vertex distance so that the cross-sectional shape of said flow channels is semi-circular, with the radius of said flow channels being in the range of 1.5 to 2.5 millimeters.

15. A fuel pump according to claim 14 wherein the depth of said flow channels along a line perpendicular to the plane of said impeller mating surfaces of said pump cover and said pump bottom is between 0.5 and 1.5 millimeters, said depth also being less than or equal to said radius of said semi-circular cross-section.

16. A fuel pump according to claim 14 wherein said depth of said flow channels along a line perpendicular to the plane of said impeller mating surfaces of said pump cover and said pump bottom is 0.9 millimeters which yields a fuel pump flowrate of 100–120 liters per hour.

17. A fuel pump according to claim 14 wherein said depth of said flow channels along a line perpendicular to the plane of said impeller mating surfaces of said pump cover and said pump bottom is 1.2 millimeters which yields a fuel pump flowrate of 200 liters per hour.

18. A fuel pump according to claim 10 wherein said semi-elliptical flow channels in said pump cover and said pump bottom are shaped according to an ellipse having a center to vertex distance in the range of 0.9 to 2.7 millimeters, and having a center to co-vertex distance of 0.8 to 2.5 millimeters.

19. A fuel pump according to claim 18 wherein the depth of said flow channels along an axis from said center to said co-vertex of said ellipse from a plane coplanar with said impeller mating surface of said pump cover and said pump bottom is between 0.5 and 2.5 millimeters, said depth also being less than or equal to the distance between said center and said co-vertex of said ellipse.

* * * * *